US012228000B2

(12) United States Patent
Younger et al.

(10) Patent No.: US 12,228,000 B2
(45) Date of Patent: Feb. 18, 2025

(54) MUD RETURNS EVAPORATIVE COOLING

(71) Applicant: SAUDI ARABIAN OIL COMPANY, Dhahran (SA)

(72) Inventors: Rae Andrew Younger, Aberdeenshire (GB); Richard Mark Pye, Aberdeen (GB)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/660,288

(22) Filed: Apr. 22, 2022

(65) Prior Publication Data

US 2023/0340844 A1 Oct. 26, 2023

(51) Int. Cl.
*E21B 21/06* (2006.01)
*E21B 36/00* (2006.01)
(Continued)

(52) U.S. Cl.
CPC ..... *E21B 21/067* (2013.01); *E21B 21/065* (2013.01); *E21B 36/001* (2013.01); *F28C 1/14* (2013.01); *F28F 1/42* (2013.01)

(58) Field of Classification Search
CPC .... E21B 21/067; E21B 21/065; E21B 36/011; F28C 1/14; F28F 25/02; F28F 2025/005;
(Continued)

(56) References Cited

U.S. PATENT DOCUMENTS 4,683,101 A * 7/1987 Cates ..... F28D 5/02 261/153
6,513,339 B1 * 2/2003 Kopko ..... F24F 3/044 62/235.1
(Continued)

FOREIGN PATENT DOCUMENTS

CA 2377424 A1 9/2003
CN 102692140 A 9/2012
(Continued)

OTHER PUBLICATIONS

Bound, Tim, "Are resilience and sustainability within data centre design mutually exclusive", Transtherm, 2021, Access Date: Apr. 22, 2022; URL: <https://transtherm.co.uk/are-resilience-and-sustainability-within-data-centre-design-mutually-exclusive/>, pp. 1-6 (6 pages).
(Continued)

*Primary Examiner* — Nicole Coy
*Assistant Examiner* — Nicholas D Wlodarski
(74) *Attorney, Agent, or Firm* — Osha Bergman Watanabe & Burton LLP

(57) ABSTRACT

An evaporative cooler for cooling drilling fluid includes a flow pipe having an inner surface in contact with drilling fluid and an outer surface in contact with an evaporative medium. The flow pipe has a serpentine configuration within a transportation frame. A system for cooling a drilling fluid includes a mud circulation system connecting the drilling fluid between a well and a surface where an evaporative cooler is coupled to the mud circulation system and has a serpentine flow pipe in a transportation frame. A method includes pumping heated drilling fluid from a wellbore to an evaporative cooling system, with an evaporative cooler to cool the heated drilling fluid, and sending the cooled drilling
(Continued)

fluid back to the wellbore. Another method includes using an intermediate cooler, wherein the intermediate cooler comprises a heat exchanger and an intermediate fluid.

19 Claims, 13 Drawing Sheets

(51) Int. Cl.
*F28C 1/14* (2006.01)
*F28F 1/42* (2006.01)

(58) Field of Classification Search
CPC .. F28F 1/42; F28F 1/422; F28F 13/187; F28F 13/0003; F28D 1/0477
See application file for complete search history.

(56) References Cited

U.S. PATENT DOCUMENTS

| | | | | |
|---|---|---|---|---|
| 10,907,878 | B2 * | 2/2021 | Fryer-Biggs | F24F 6/04 |
| 2007/0240864 | A1 * | 10/2007 | Yabu | F28F 1/32 165/150 |
| 2011/0113820 | A1 * | 5/2011 | Lee | F28F 1/40 165/181 |
| 2012/0297801 | A1 | 11/2012 | Sun et al. | |
| 2014/0298899 | A1 * | 10/2014 | Schexnaider | G01N 33/2823 165/61 |
| 2014/0367067 | A1 * | 12/2014 | Jain | F28D 1/0472 165/45 |
| 2015/0153074 | A1 * | 6/2015 | Antel, Jr. | F28D 1/0472 165/45 |
| 2015/0330165 | A1 | 11/2015 | Thiessen | |
| 2017/0160015 | A1 * | 6/2017 | Aaron | F28F 25/12 |
| 2018/0320462 | A1 * | 11/2018 | McCraw | E21B 36/001 |
| 2020/0278155 | A1 * | 9/2020 | Sawyer | F28F 27/003 |
| 2021/0055066 | A1 * | 2/2021 | Gan | C23C 10/00 |
| 2021/0180891 | A1 * | 6/2021 | Rousselet | F24F 11/70 |

FOREIGN PATENT DOCUMENTS

| | | | |
|---|---|---|---|
| CN | 203561230 | U | 4/2014 |
| CN | 203978347 | U | 12/2014 |
| CN | 206192154 | U | 5/2017 |
| CN | 110847832 | A | 2/2020 |
| CN | 110847833 | A | 2/2020 |
| CN | 210888851 | U | 6/2020 |
| CN | 211342839 | U | 8/2020 |

OTHER PUBLICATIONS

Javay, Alexandra, et al., "Mud Cooler and Chiller Packages in High-Temperature Deep Horizontal Gas Wells: A Case Study from Saudi Arabia", SPE-203260-MS, Society of Petroleum Engineers, Nov. 2020, pp. 1-17 (17 pages).

"Mud Cooling System" Flow Process Technologies, Inc., 2018, Access Date: Apr. 21, 2022, URL: <https://flowprocess.com/mud-coolers/>, pp. 1-9 (9 pages).

NMMarauder, "Build an evaporative refrigerator—no moving parts, no electricity", Rebuilding Civilization, Jun. 16, 2012, Access date: Apr. 21, 2022, URL: <https://www.rebuildingcivilization.com/index.php/2012/06/16/build-evaporative-refrigerator-no-moving-parts-no-electricity/>, pp. 1-7 (7 pages).

* cited by examiner

MUD RETURNS EVAPORATIVE COOLING

BACKGROUND

Equipment used in downhole drilling and in hydrocarbon recovery operations may be exposed to high temperatures and pressures in the subsurface reservoir that may cause downhole equipment to fail and break. Drilling mud is circulated from the surface to the downhole well environment to cool downhole equipment and to remove drilled cuttings. The flow of the cooler drilling mud from the surface reduces the operating temperature of the downhole environment and drill string, including electronics, metals, materials, and seals. The circulated mud absorbs heat from the formation, friction generated by the cutting process, and friction from the rotating drillpipe in the wellbore, causing the temperature of the mud to increase. Consequently, the mud is circulated back to the surface where it cools before being circulated into the well again. Where the surface temperatures are hot, for example in summer months, the hot returned mud does not sufficiently cool before being recirculated into the well. This causes elevated bottom-hole temperatures that are detrimental to drilling equipment. Drilling may be periodically suspended to allow muds at surface to cool, but this is undesirable and may extend the drilling campaign.

SUMMARY

Generally, the present disclosure is directed toward solutions for cooling drilling mud or drilling fluid. More specifically, some embodiments herein are directed toward a new evaporative cooler. One illustrative evaporative cooler disclosed herein includes a flow pipe having an inner surface in contact with drilling fluid, and an outer surface in contact with an evaporative medium. The evaporative medium may be liquid water, for example. The flow pipe in an evaporative cooler may be in a serpentine configuration and held within a transportation frame.

The transportation frame of the evaporative cooler may be connected to a cover used to reclaim condensation of the evaporative medium, a solar panel to power onboard electronics, and a storage tank that distributes the evaporative medium to the outer surface of the flow pipe. The inner and outer surfaces of the flow pipe may contain fins and the outer of the flow pipe may be covered with substance or material that may be porous. A substance or material may be made of a diverse range of materials including clay, fiber reinforced clay, fabric aramid cloth, Cordura®, ballistic nylon, and combinations thereof.

Also disclosed herein is a system for cooling drilling fluid that includes, among other things, a mud circulation system fluidly connecting the drilling fluid between a well and a surface. The system for cooling drilling fluid also includes an evaporative cooler fluidly coupled to the mud circulation system. The evaporative cooler may include, for example, a flow pipe contained in a transportation frame with a serpentine configuration and having an inlet and an outlet that are connected to the mud circulation system. The mud circulation system may also include, for example, a mud degasser, a shale shaker, one or more mud pumps, and a recirculation line configured to circulate a portion of the drilling fluid to the evaporative cooler. Further, the mud circulation system may include a mud storage coupled to an evaporative cooler.

Also disclosed herein is a method that includes pumping a hot drilling fluid from a wellbore, directing the hot drilling fluid to an evaporative cooling system, where the evaporative cooling system has an evaporative cooler, using the evaporative cooling system to cool the hot drilling fluid, and directing cooled drilling fluid from the evaporative cooling system back to the wellbore.

The method may also include pumping the hot drilling fluid from the wellbore to a mud storage, pumping the hot drilling fluid from the mud storage to the evaporative cooler, returning the cooled drilling fluid from the evaporative cooler to the mud storage, and directing the cooled drilling fluid from the mud storage to the wellbore.

In another method, an evaporative cooling system may use an intermediate cooler, where the intermediate cooler comprises a heat exchanger, and an intermediate fluid flow pipe connecting an inlet of the evaporative cooler and outlet of the evaporative cooler to the heat exchanger. This method may include cooling an intermediate fluid in the evaporative cooler, flowing the cooled intermediate fluid from the outlet of the evaporative cooler through the intermediate fluid flow pipe to the heat exchanger, flowing the hot drilling fluid through the heat exchanger where heat exchanges between the hot drilling fluid and the cooled intermediate fluid to cool the drilling fluid and heat the intermediate fluid, and directing the heated intermediate fluid from the heat exchanger to the inlet of the evaporative cooler to cool the heated intermediate fluid. The intermediate fluid used in this method may be water, for example.

DETAILED DESCRIPTION

Figure 1A:
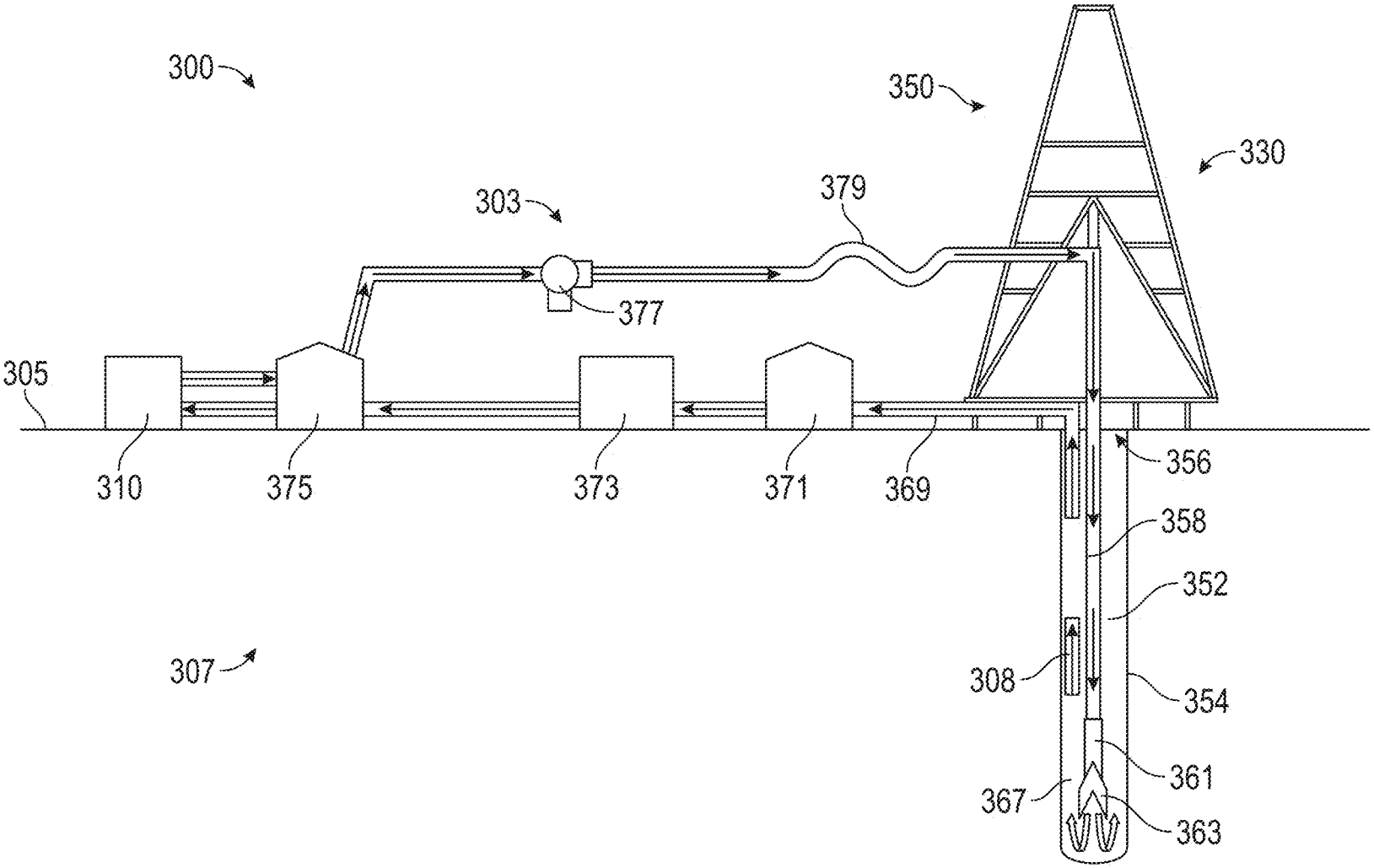
FIG. 1A is a diagram that illustrates a reservoir environment with an evaporative cooling system according to one or more embodiments.

Various methods exist to cool mud at the surface in a drilling environment. Mud may be interchangeably referred to as drilling fluid or drilling mud herein. For example, hot drilling fluid may be referred to as hot drilling mud and cooled drilling fluid may be referred to as cooled drilling mud. In one method, mud may be stored in mud pits located at the surface. While the mud remains in the mud pit, it will dissipate heat into the environment. The rate of mud heat loss is reduced when ambient temperatures are high. Increasing surface mud volume would allow mud to remain at the surface for a long period however, this soon becomes impractical from both a logistics and cost perspective.

In another method, refrigeration equipment may be used to attempt to cool the mud. However, refrigeration requires significant energy consumption to function properly. In certain environments, energy consumption is especially high, such as environments with high temperatures, because the rate of cooling decreases as the air temperature increases. Additional cooling units increases the chance of failure and breakdowns.

A mud circulation system with an evaporative cooler and their method of use are proposed for improving the cooling of hot mud during drilling operations.

In the mud circulation system, drilling fluid containing hot mud is provided to the surface from a wellbore that is part of a drilling system. At the surface, the hot drilling mud is processed and passed to an evaporative cooler, where the mud is cooled by evaporative cooling, and then reintroduced into the wellbore. Evaporative cooling may also be referred to as adiabatic cooling.

According to embodiments of the present disclosure, an evaporative cooler may include a flow pipe that has a serpentine configuration and is contained inside a transportation frame. The transportation frame may be configured to support devices that aid the evaporative cooling process, such as storage tanks and a cover. In some embodiments, mud may be directed through the flow pipe to be cooled by surface evaporation around the flow pipe. In some embodiments, mud may be directed through and cooled in a heat exchanger circuit with a cooling fluid, where the cooling fluid is cooled through the evaporative cooler.

In the mud circulation system, drilling fluid containing hot mud is provided to the surface from a wellbore that is part of a drilling system. At the surface the hot mud may be processed and passed to an evaporative cooler where the mud is cooled by evaporative cooling. In some embodiments, hot drilling mud at the surface may be cooled in a heat exchanger using a cooling fluid, where the cooling fluid may be cooled by evaporative cooling. The cooled drilling mud may be stored in a mud storage (e.g., a mud tank or pit) and reintroduced into the wellbore when needed.

Various illustrative embodiments of the disclosed subject matter are described. In the interest of clarity, not all features of an actual implementation are described in this specification. It will of course be appreciated that in the development of any such actual embodiment, numerous implementation-specific decisions must be made to achieve the specific goals of the developers, such as compliance with system-related and business-related constraints, which will vary from one implementation to another. Moreover, it will be appreciated that such a development effort might be complex and time-consuming but may be a routine undertaking for those of ordinary skill in the art having the benefit of this disclosure.

The present subject matter will now be described with reference to the attached figures. Various structures, systems, and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used should be understood and interpreted to have a meaning consistent with the understanding of those words and phrases by those skilled in the relevant art. No special definition of a term or phrase, that is, a definition that is different from the ordinary and customary meaning as understood by those skilled in the art, is intended to be implied by consistent usage of the term or phrase. To the extent that a term or phrase is intended to have a special meaning, that is, a meaning other than that understood by skilled artisans, such a special definition will be expressly set forth in the specification in a definitional manner that directly and unequivocally provides the special definition for the term or phrase. With reference to the attached figures, various illustrative embodiments of the systems, devices and methods disclosed will now be described in more detail.

System

Figure 1B:
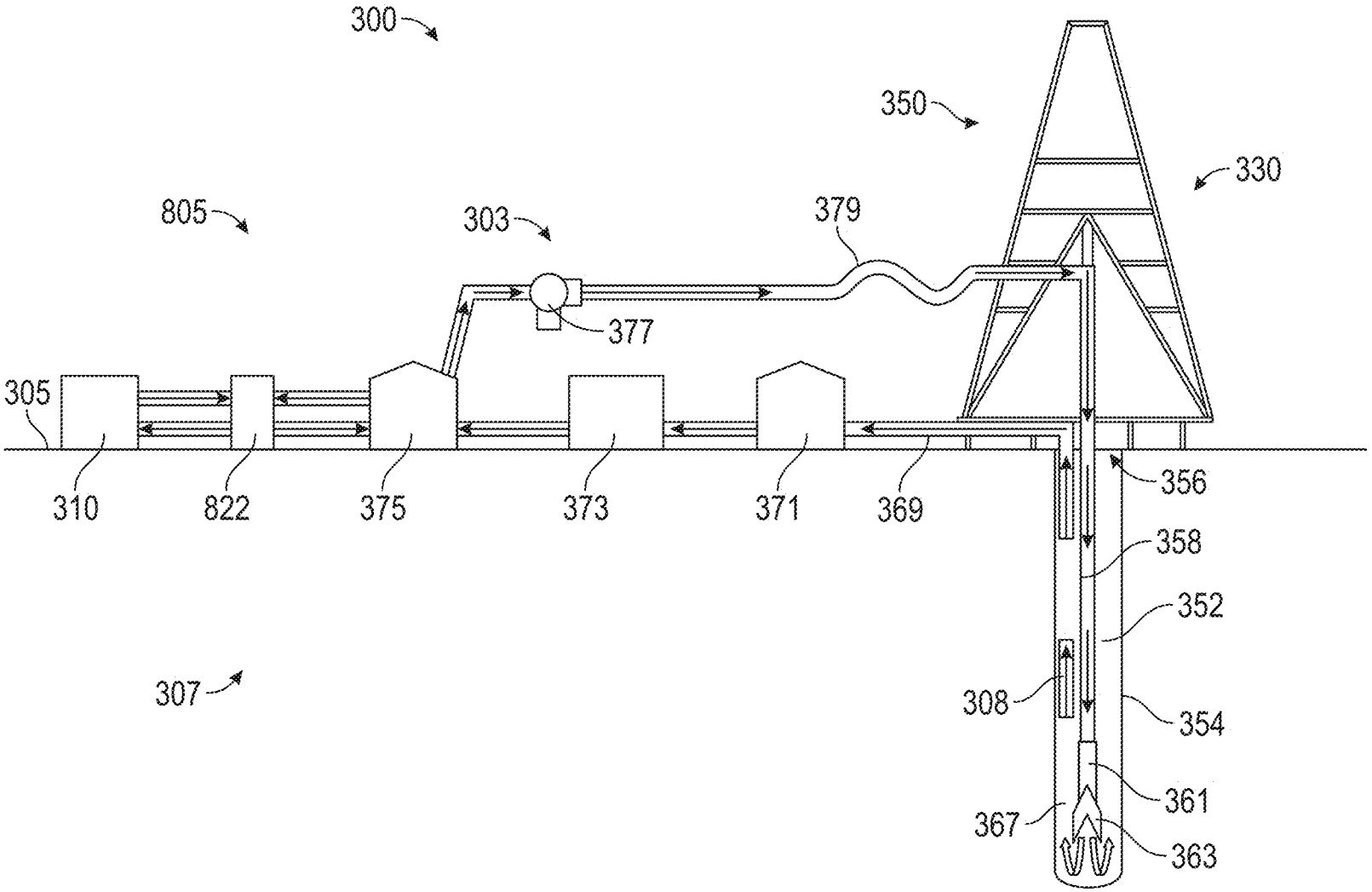
FIG. 1B is a diagram that illustrates a reservoir environment with an evaporative cooling system according to one or more embodiments.
Figure 1C:
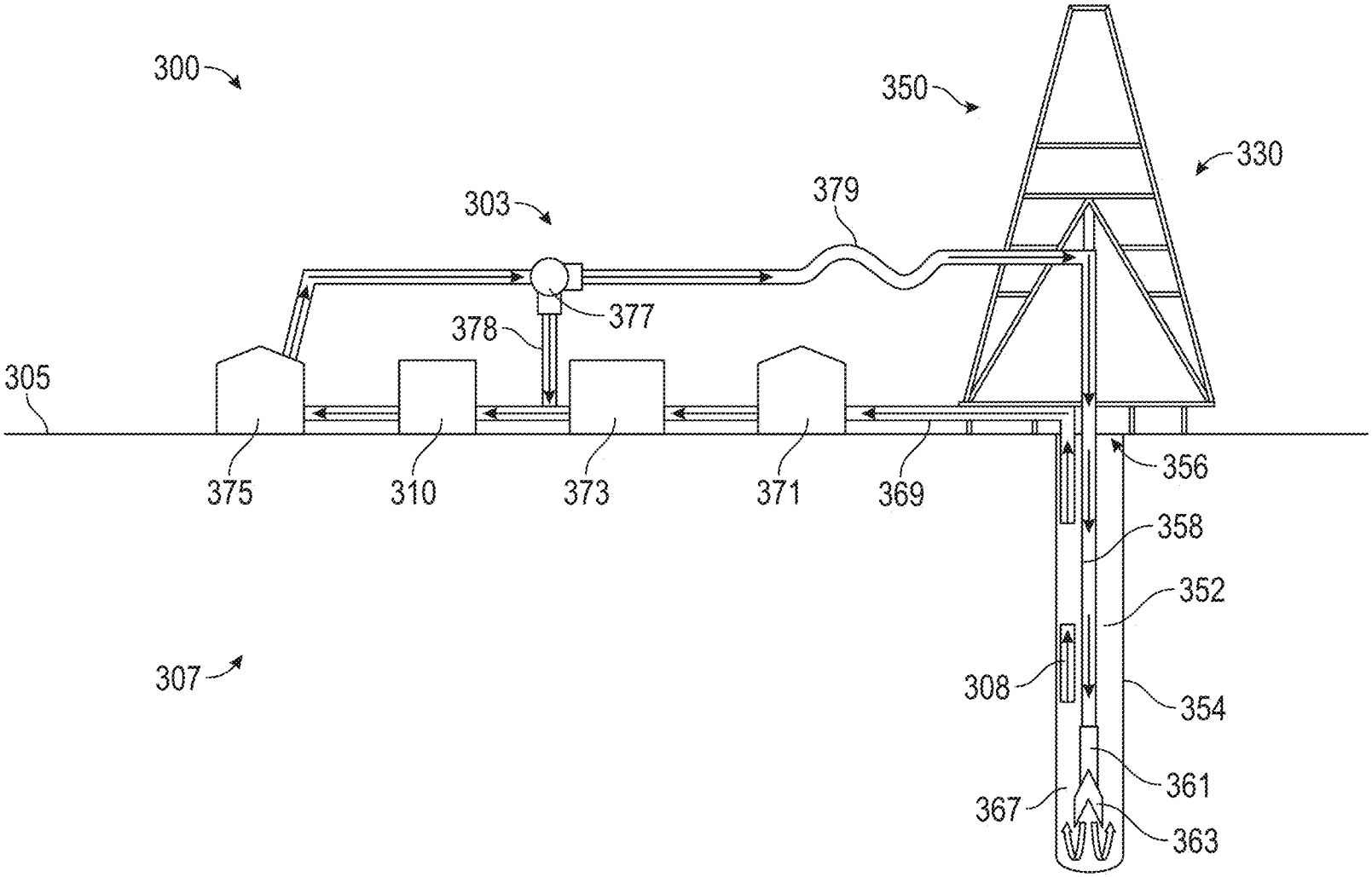
FIG. 1C is a diagram that illustrates a reservoir environment with an evaporative cooling system according to one or more embodiments.

FIGS. 1A-1C are diagrams that illustrate reservoir environments with an evaporative cooling system according to one or more embodiments. The reservoir systems 300 provided in FIGS. 1A-1C include a drilling system 350, a surface 305 representing the surface of the Earth, and a subsurface 307 below the surface 305. Subsurface 307 has a wellbore 352 traversing through it in a generally downward direction. The wellbore 352 is defined by a wellbore wall 354 and is a void that has been drilled through the subsurface 307 at a wellbore face 356, where contact between the subsurface and the drilling system 350 is active. Fluid communication is operable between the surface 305 and the subsurface 307 via wellbore 352, as will be further described.

As part of drilling system 350, there are several pieces of equipment shown in FIGS. 1A-1C positioned above and about the wellbore 352 to support drilling activities. A derrick 330 is positioned above the wellbore 352. Derrick 330 supports a drill pipe 358 traversing downward through the wellbore 352. At the distal end of the drill pipe 358, a bottom hole assembly 361 contains a number of units. At the very distal end of the bottom hole assembly 361, a drill bit 363 is utilized to remove rock from the subsurface 307. Drill bit 363 includes several fluid holes (not shown) that permit in part fluid communication between the surface 305 and the wellbore 352.

Mud circulation system 303 is also part of drilling system 350. The Mud circulation system 303 provides fluid drive for drilling mud 308 through the wellbore 352 for several purposes well appreciated in the art, including, but not limited to, lubricating and cooling the drill bit 363 and other equipment in the wellbore 352 during drilling operations. As well, the circulating drilling mud 308 transports cutting and other debris from the wellbore face.

As drilling mud 308 is circulated through the wellbore 352, subsurface temperatures in the wellbore 352 heat the drilling mud 308. Cuttings are carried up with the hot drilling mud 308 via the wellbore annulus 367 and onto the surface 305 through mud return line 369, which also provides a conduit for fluid communication with the wellbore 352. From the mud return line 369, gas-entrained drilling mud 308 is circulated through a mud degasser 371, where volatile gases are separated from the hot drilling mud 308. The hot drilling mud 308 is then passed to a shale shaker 373 that may be positioned downstream from the mud degasser 371. In the shale shaker 373, the cuttings and micro-sized solids and debris are separated from the hot drilling mud 308.

In one or more embodiment systems, as shown in FIG. 1A, the hot drilling mud 308 then passes into a mud storage 375 where it is stored. In one or more embodiments, the mud storage may be a mud tank. In one or more embodiments the mud storage may be a mud pit. The hot drilling mud 308 is then passed into an evaporative cooler 310 where the drilling mud 308 may be substantially cooled down without requiring refrigeration. In one or more embodiments, the shale shaker 373 may be positioned upstream from the mud degasser 371. In one or more embodiments, the hot drilling mud 308 is passed from the mud storage 375 to the evaporative cooler 310 without being stored. After cooling in the evaporative cooler 310, the cooled drilling mud 308 may be returned to the mud storage 375, where the cooled drilling mud 308 may mix with hot drilling mud 308 returning from the drilling system 350. In some embodiments, the cooled drilling mud 308 from the evaporative cooler 310 may be passed into a separate portion of the mud storage 375 or into a separate mud storage to keep cooled drilling mud separated from hot drilling mud 308 returning from the drilling system 350, where the cooled drilling mud 308 may be stored until needed. By circulating drilling mud from the mud storage 375 to the evaporative cooler 310, drilling mud may be continuously cooled irrespective of the main mud circulation system operation. For example, drilling mud 308 may be circulated between the mud storage 375 and the evaporative cooler 310 whether or not mud pumps are circulating hot drilling mud from the drilling system 350 to the mud storage 375 or from the mud storage 375 back to the drilling system 350.

Figure 8:
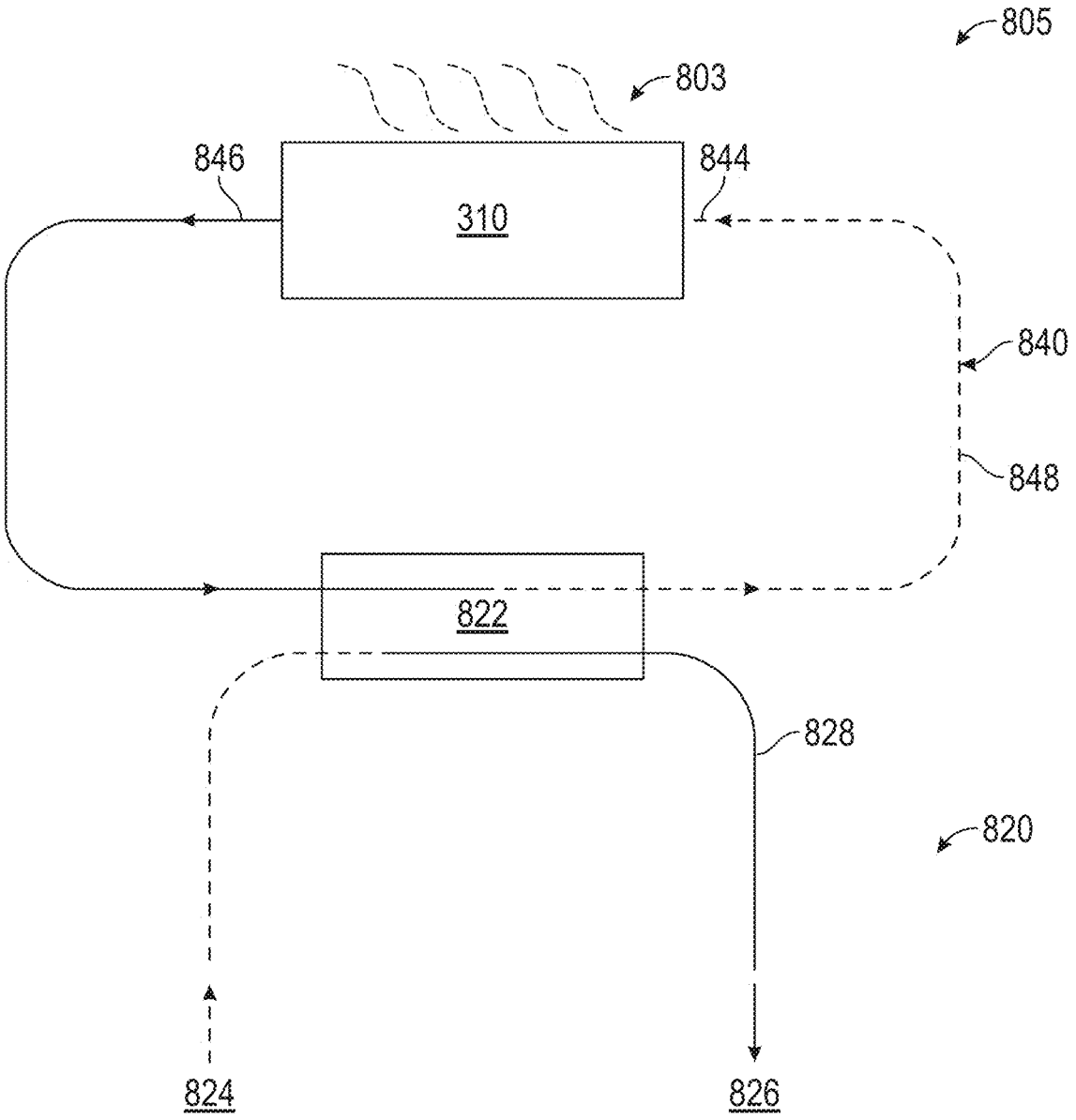
FIG. 8 illustrates a schematic diagram of an evaporative cooling system in accordance with one or more embodiments.

In one or more embodiment systems as shown in FIG. 1B, an evaporative cooler 310 may be part of a dual circuit evaporative cooling system 805. The dual circuit evaporative cooling system 805 may include a mud storage 375 from where hot drilling mud 308 is passed into an intermediate cooler 822 to be cooled. The intermediate cooler 822 may be configured to contain an intermediate fluid, which may be heated via heat transfer from the hot drilling mud 308. The heated intermediate fluid is passed from the intermediate cooler 822 to an evaporative cooler 310. The evaporative cooler 310 is configured to cool the intermediate fluid, and the cooled intermediate fluid is configured to return to the intermediate cooler 822. The cooled returned intermediate fluid may then gain heat through heat exchange in the intermediate cooler 822, thereby continuing the cycle of cooling the drilling mud 308 in the intermediate cooler 822. Dual circuit evaporative cooling systems are also shown in FIG. 8 and described in more detail below. The cooled drilling mud 308 is passed to the mud storage 375 from the intermediate cooler 822.

According to some embodiments of the present disclosure, a commercially available cooler 310 may be used in combination with the intermediate cooler 822 to cool the intermediate fluid. In such embodiments, the intermediate cooler 822 may be used as a buffer heat exchanger to improve reliability of the commercially available cooler 310. In other embodiments, a cooler 310 in accordance with embodiments described herein may be used in combination with the intermediate cooler 822 to cool the intermediate fluid.

In one or more embodiment systems as shown in FIG. 1C, rather than providing a separate circulation system for circulating hot drilling mud 308 from a mud storage 375 to an evaporative cooler 310, an evaporative cooler 310 may be provided inline between the drilling system 350 and the mud storage 375. For example, hot drilling mud 308 may be directed from a shale shaker 373 into an evaporative cooler 310, where the drilling mud 308 is substantially cooled down without having to use refrigeration. After the drilling mud 308 is cooled in the evaporative cooler 310, the cooled drilling mud is passed to a mud storage 375, where it may be stored until needed.

In one or more embodiment systems as shown in FIG. 1C, mud pumps 377 may be configured to continuously circulate mud through a cooling cycle between the cooler 310 and the mud storage 375. Thus, in such embodiments, valving and pipework may be provided in the cooling cycle to provide capabilities to the cooling cycle to handle many different flow rates (e.g., different flow rates from different operational circumstances, such as when mud is not circulated back to the wellbore and when mud is being circulated back to the wellbore). For example, in the embodiment shown in FIG. 1C, mud pumps 377 are configured to circulate a portion of the drilling mud 308 back to the evaporative cooler 310 from a recirculation line 378. In one or more embodiments, a recirculation line 378 may be fluidly connected along a flow path between the shale shaker 373 and the evaporative cooler 310. Those having skill in the art will appreciate that several different types of connections, valves, and lines may be used to adjust the mudflow of the drilling mud 308 returning to the evaporative cooler 310. Additionally, the cooler 310 may be designed to have a size capable of accommodating the anticipated range of mud flow to continue to operate effectively, or multiple coolers 310 (e.g., a primary cooler and at least one secondary cooler) may be fluidly connected (e.g., in series or in parallel) in the mud circulation system 303 to accommodate the anticipated range of mud flow.

As part of drilling system 350, as shown in FIGS. 1A-1C, when required, mud pumps 377 draw cooled drilling mud 308 from the mud storage 375 and into the mud injection line 379, which is coupled to the derrick 330 and the drill pipe 358, which has a proximal end sticking out above the wellbore 352. The cooled drilling mud 308 is then reintroduced into the wellbore 352 the drill pipe 358 and back downhole toward the drill bit 363, where the mud circulation begins again.

Apparatus

Figure 2A:
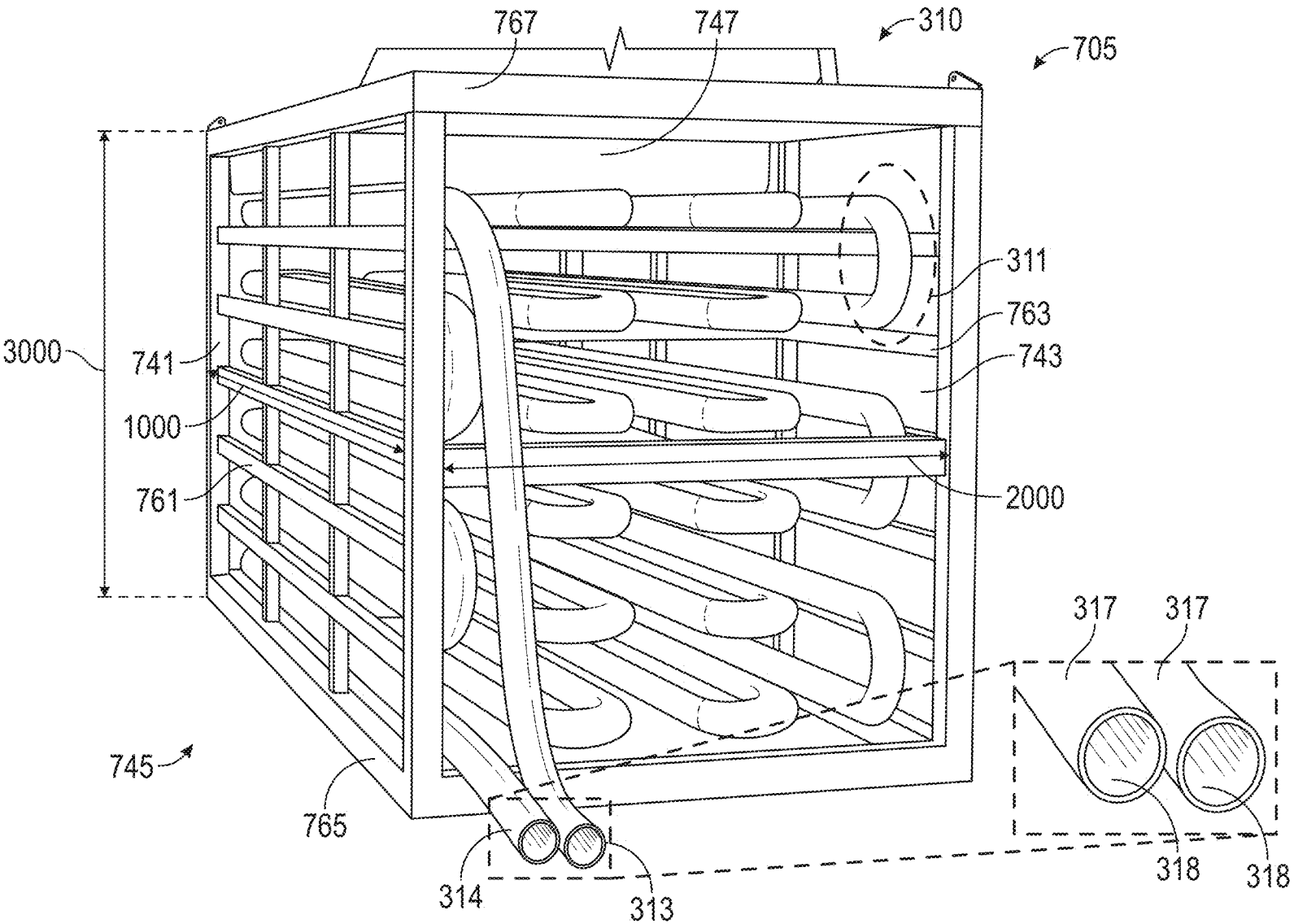
FIG. 2A illustrates a perspective view of an evaporative cooler according to one or more embodiments.
Figure 2B:
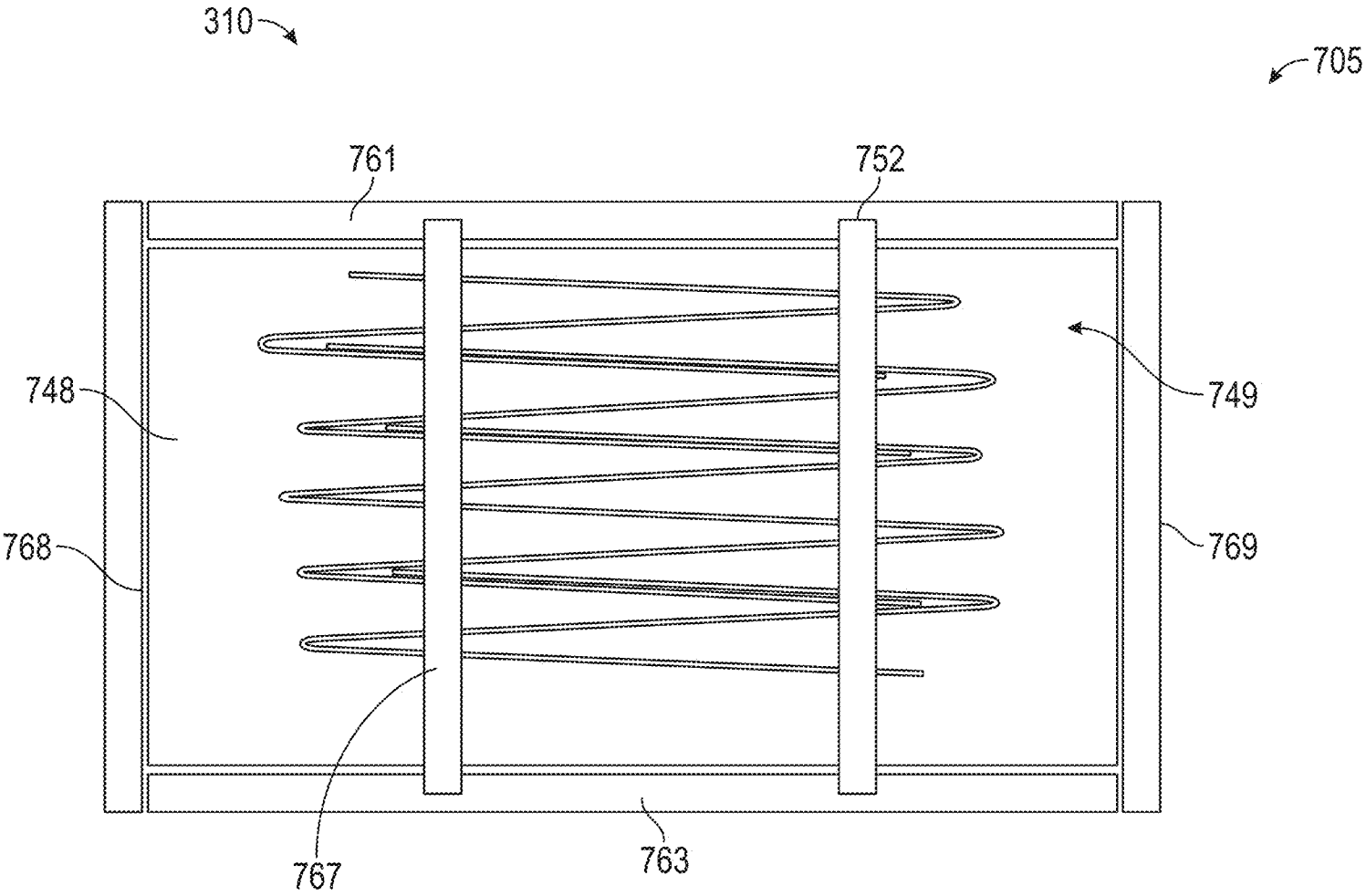
FIG. 2B illustrates a perspective view of an evaporative cooler according to one or more embodiments.

FIGS. 2A-2B illustrate views of an evaporative cooler 310 according to embodiments of the present disclosure. FIG. 2A illustrates a perspective view of the evaporative cooler 310. The evaporative cooler 310 includes a flow pipe 311 having an inlet 313 and an outlet 314. The inlet 313 and the outlet 314 of the flow pipe 311 may couple to fluid conduits that introduce and pass drilling fluid, respectively. In one or more embodiments, hot drilling mud may be introduced into the inlet 313 and cool drilling mud may exit from the outlet 314. The evaporative cooler 310 may comprise a flow pipe 311 having an inner surface 318 and an outer surface 317 (insert). The inner surface 318 of flow pipe 311 is configured to contact drilling fluid; the outer surface 317 of flow pipe 311 is configured to contact an evaporative fluid.

In one or more embodiments, the flow pipe 311 may be configured in a form that increases the length of the fluid flow pathway or otherwise maximizes fluid-to-conduit surface area within a compact assembly footprint of the evaporative cooler 310. For example, in one or more embodiments the flow pipe 311 may have a serpentine configuration that forms a back-and-forth fluid flow pathway. The overall shape of the flow pipe 311 having a serpentine configuration may approximately form a right rectangular prism having a first flow pipe face 741, a second flow pipe face 743, a third flow pipe face 745, a fourth flow pipe face 747 opposite the third flow pipe face 745, a fifth flow pipe face 748 (see FIG. 2B) opposite the first flow pipe face 741, and a sixth flow pipe face 749 (see FIG. 2B) opposite the second flow pipe face 743. The flow pipe faces define a length 1000, a width 2000 and height 3000 of the evaporative cooler 310, as shown in FIG. 2A by imaginary perpendicular lines running along the evaporative cooler. In one or more embodiments, the serpentine flow configuration of the flow pipe 311 may be in a horizontal dominant configuration where more of the segments of the flow pipe 311 are configured to run in a side-by-side arrangement as represented by the length 1000 and the width 2000, and occasionally transitioning vertically as represented by height 3000. In one or more embodiments, the serpentine flow configuration of the evaporative cooler may be vertical dominant where more of the segments of the flow pipe 311 are configured up and down as represented by the height 3000 and occasionally transitioning horizontally as represented by the length 1000 and the width 2000. In some embodiments, the length 1000 of an evaporative cooler 310 may be at least 5 meters, e.g., 10 meters or more.

The flow pipe 311 may be made of any material that may be suitable for the operation, such as steel. In one or more the embodiments the flow pipe may be made from flexible materials including, but not limited to a flexible metal hose. Sections of the flow pipe may be connected together by any means known in the industry, such as welding or using bolted flanges. Those having skill in the art will appreciate that several different types of materials may be used to make the flow pipe and to connect sections of the flow pipe together.

FIG. 2B illustrates a top view of a portion of the evaporative cooler 310 according to one or more embodiments. The evaporative cooler 310 may comprise a transportation frame 705. The transportation frame 705 may be composed of a first frame panel 761, a second frame panel 763 opposite the first frame panel 761, a third frame panel 765, a fourth frame panel 767 opposite the third frame panel 765, a fifth frame panel 768, and a sixth frame panel 769 opposite the fifth frame panel 768, shown collectively in FIGS. 2A and 2B. The frame panels may be rectangular, with each having a height, a width, and a length. The frame panels may be connected together to form a right rectangular prism enclosing the serpentine configuration of the flow pipe 311 within the transportation frame 705.

In one or more embodiments, a frame panel of the transportation frame 705 may have a different configuration with respect to another frame panel of the transportation frame. In one or more embodiments, a base frame panel (e.g., third frame panel 765) is configured to pool or collect a medium such as a liquid and may be in the shape of a gutter or a trough, or a collection pan, such as shown in FIGS. 2A and 2B. In one or more embodiments, a frame panel of the transportation frame 705 may be a configuration of multiple rectangular segments 752 having spaces in between, where shape, size, configuration, and spacing of the segments 752 may vary. For example, the fourth frame panel 767 has two segments 752 whereas first frame panel 761 (FIG. 2A) has seven segments. In one or more embodiments, the segments of a frame panel may couple or connect other frame panels together. For example, segment 752 of the fourth frame panel 767 couple or connect first frame panel 761 and second frame panel 762 together. Support segments may be configured to allow attachment of other items to the evaporative cooler (e.g., as described more below). The frame panels of the transportation frame may be coupled or connected by any means known in the art, such as welding or using a bolted flange connection. In one or more embodiments, the frame panels of the transportation frame may be fabricated from steel, aluminum, titanium, or high density polyethylene. Those having skill in the art would appreciate that the frame panels may be constructed from a variety of materials and may be connected by a variety of methods.

In one or more embodiments, the transportation frame is configured to include a structure that may be used to transport the evaporative cooler. For example, the transportation frame may have lock corners, forklift pockets, pad eyes, lift eyes, and trailer connectors as would be appreciated by those having skill in the art.

Figure 3:
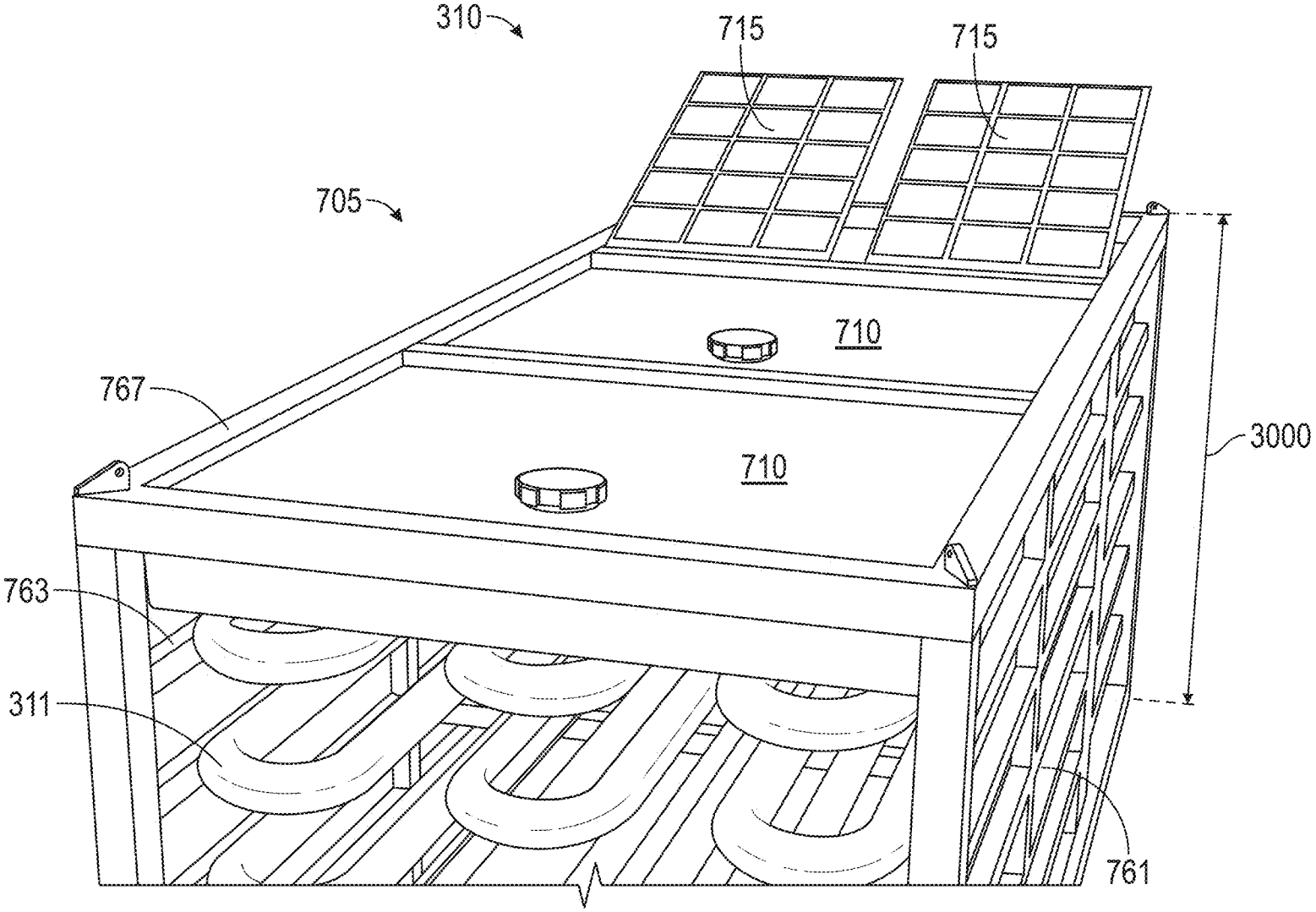
FIG. 3 illustrates a perspective view of a section of an evaporative cooler according to one or more embodiments.

Storage tanks configured to store an evaporative medium (e.g., water) may be located externally to the evaporative cooler and may be coupled or connected to pumps used to supply the evaporative medium to the evaporative cooler. In some embodiments, one or more storage tank may be sited remotely from but fluidly connected to an evaporative cooler. In some embodiments, one or more storage tanks may be connected to an evaporative cooler. FIG. 3 illustrates a perspective view of a section of the evaporative cooler 310 according to one or more embodiments where storage tanks 710 may be coupled or connected to the transportation frame 705. The storage tanks 710 coupled or connected to the transportation frame 705 may be configured to store an evaporative medium. In one or more embodiments, the storage tanks 710 may be configured to have a mechanism that dispenses the evaporative medium on the flow pipe within the evaporative cooler 310. For example, the storage tanks 710 may have one or more outlets, such as holes, where the outlet(s) may be directed in a direction toward a flow pipe 311 in the evaporative cooler 310. The outlets may allow the evaporative medium to dispense from the storage tanks 710 onto the flow pipe 311. In some embodiments, outlet(s) of a storage tank may be positioned above a portion of the flow pipe 311, where evaporative medium may flow from the storage tank, through the outlet(s), and to the flow pipe via gravity. In some embodiments, a pump (e.g., an electric pump powered by solar power, battery, or other power source) may be used to pump the evaporative medium from one or more storage tanks to dispense an evaporative medium on the flow pipe 311. In one or more embodiments, the storage tanks 710 may be coupled to a dispensing mechanism such as a sprinkler, where the sprinkler may spray the evaporative medium on at least a portion of the flow pipe 311.

The location of the storage tanks 710 may vary. For example, the storage tanks may be attached to a frame panel 767 at the top of the transportation frame. However, additional storage tanks may be placed in different height locations, such as where space is available between loops of the flow pipe 311. For example, storage tanks may be placed between first frame panel 761 and second frame panel 763 at various positions along height 3000. Those having skill in the art will appreciate that the storage tanks may be located in multiple spaces and configurations of the evaporative cooler. Optionally, the storage tanks may be removable and replaceable. In one or more embodiments, the storage tanks 710 are configured such that a storage tank may be replaced while other storage tank(s) are in operation.

An evaporative cooler may have various associated components that use electricity to operate, including, but not limited to, onboard sensors, fans, pumps (e.g., a pump to pump evaporative medium on a flow pipe in the evaporative cooler), and valves. In one or more embodiments, electrical components may be integrally provided with an evaporative cooler, e.g., located onboard the evaporative cooler and coupled to the transportation frame 705. In one or more embodiments, the components that use electricity may be in a separate module and may be coupled with the evaporative cooler 310 by cabling between module and the evaporative cooler 310. In one or more embodiments, electricity may be supplied to electrical components associated with an evaporative cooler by solar power. In FIG. 3, solar panels 715 are coupled or connected to a section of the transportation frame 705. The solar panels 715 may be foldable and folded flat to avoid damage when transporting the evaporative cooling system. The solar panels may also be removable.

Figure 4A:
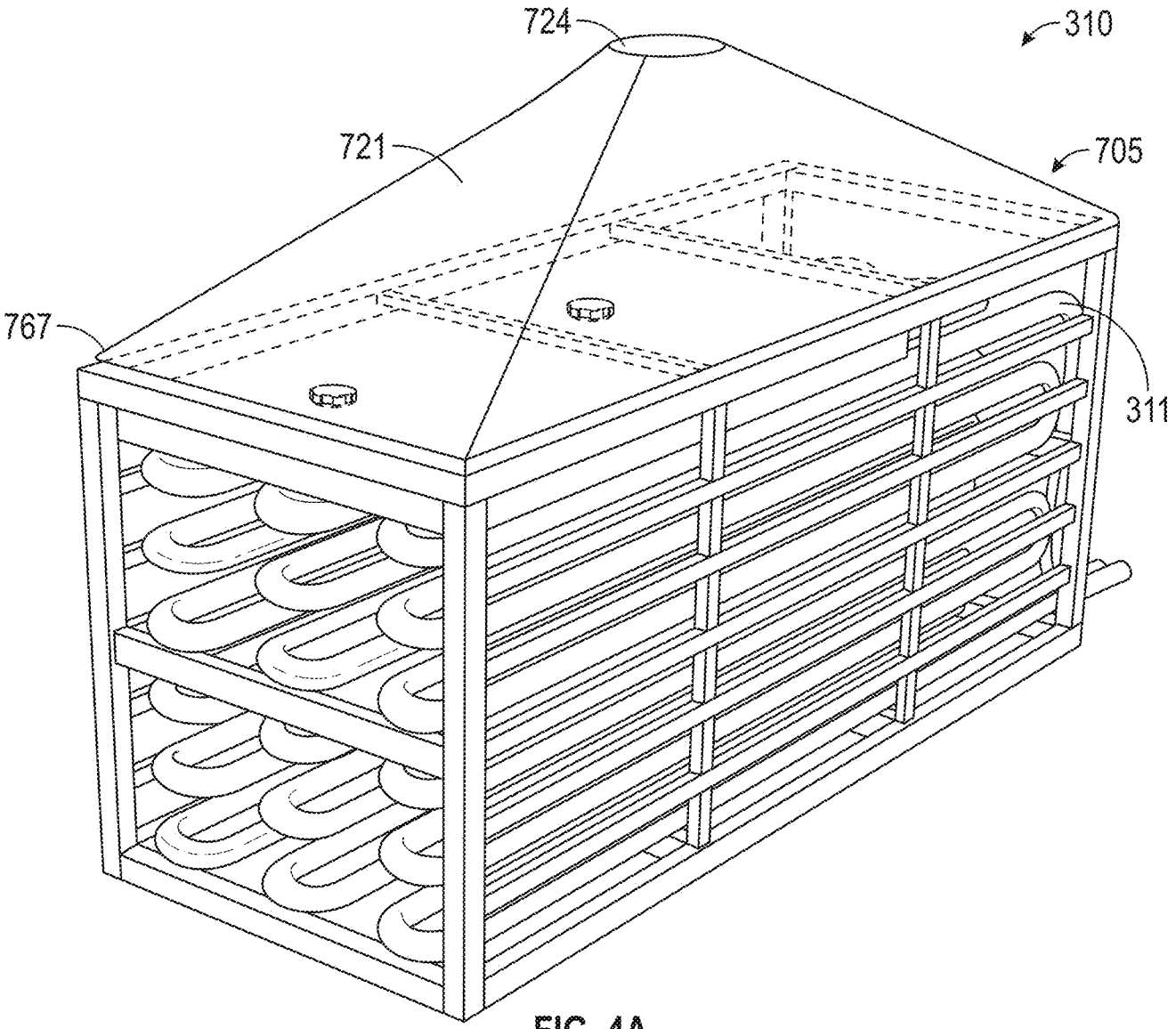
FIG. 4A illustrates a perspective view of a section of an evaporative cooler according to one or more embodiments.

FIG. 4A illustrates a perspective view of an evaporative cooler according to one or more embodiments. The evaporative cooler 310 may be configured to include a cover 721. The cover 721 may be attached to one or more frame panels of the transportation frame. For example, the cover may be attached to a frame panel 767 at the top of the transportation frame 705. The cover 721 may have many possible shapes, including but not limited to, conical, cuboid, or pyramidal. As can be seen in FIG. 4, an example cover 721 is in the shape of a rectangular pyramid. The cover 721 may be constructed from many possible materials and may be transparent or translucent. In one or more embodiments, the cover may be configured to reflect light or heat to promote condensation. The cover may also have an opening 724 at the top (the side farthest away from the transportation frame) that may be configured in different shapes and sizes. The inner surface of the cover is configured to collect condensation of the evaporative medium in a liquid state. In some embodiments, collected condensation may flow to a channel or trough or the like along the evaporative cooler transportation frame, where the collected condensation may be pumped to a storage tank or otherwise recirculated to be dispensed on a flow pipe in the evaporative cooler.

Figure 4B:
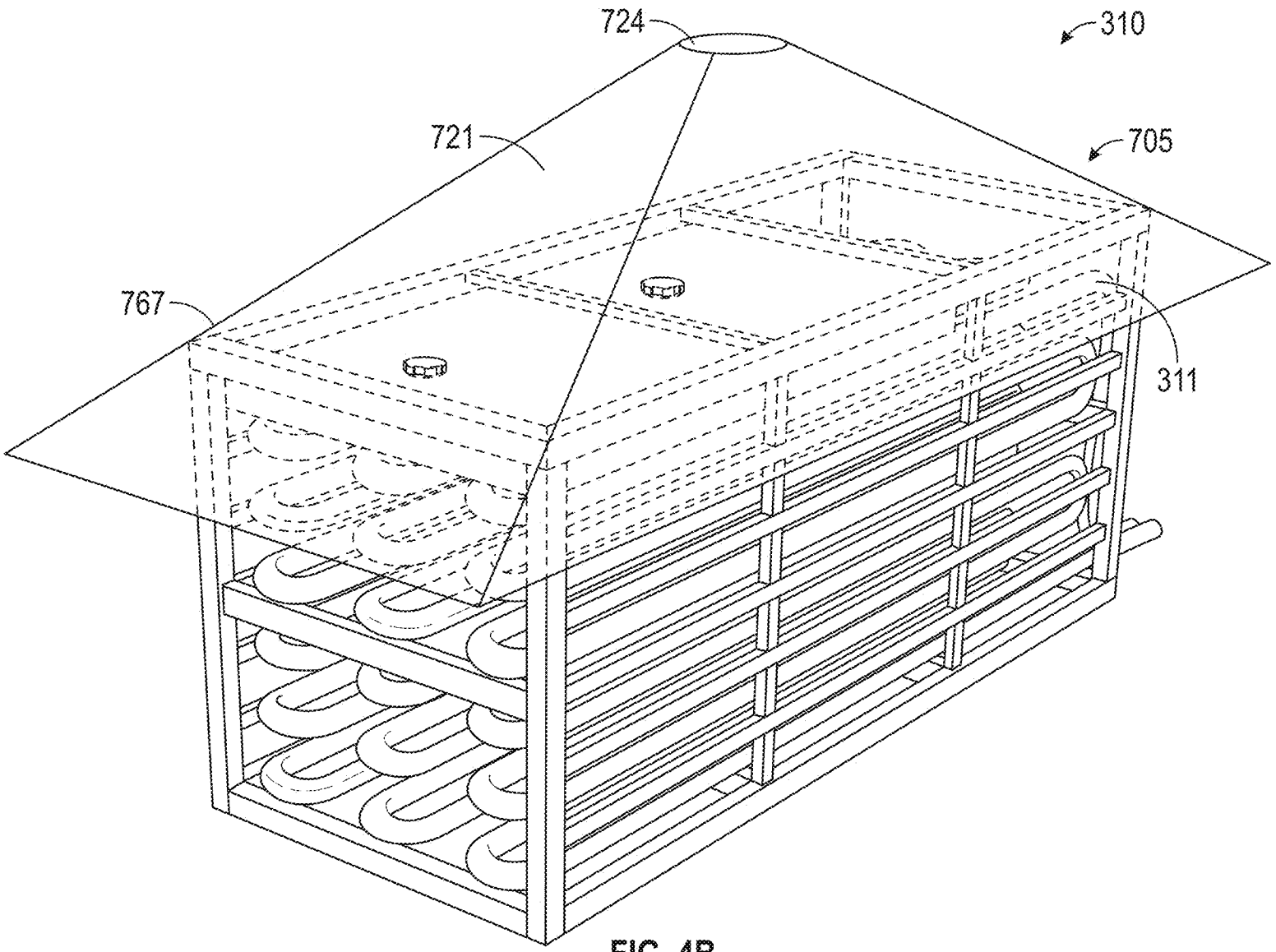
FIG. 4B illustrates a perspective view of a section of an evaporative cooler according to one or more embodiments.

In one or more embodiments, the cover 721 may extend beyond the evaporative cooler transportation frame to cover a greater area than the footprint of the transportation frame as illustrated in FIG. 4B. In one or more embodiments, a cover that extends beyond the evaporative cooler frame footprint may be attached to one or more frame panels of the transportation frame. In one ore more embodiments, a cover that extends beyond the evaporative cooler frame footprint may cover the evaporative cooler but is not attached to the transportation frame. For example, the cover may be configured to have parts that rest on the transportation frame or other surface above the evaporative cooler. In one or more embodiments, the cover 721 may be foldable or collapsible for transit or when the cover is not in use. In one or more embodiments, the cover 721 may be a detachable cover such that it may be disconnected from the evaporative cooler 310. Those having skill in the art will appreciate that there are several ways to construct a collapsible cover structure.

Figure 5A:
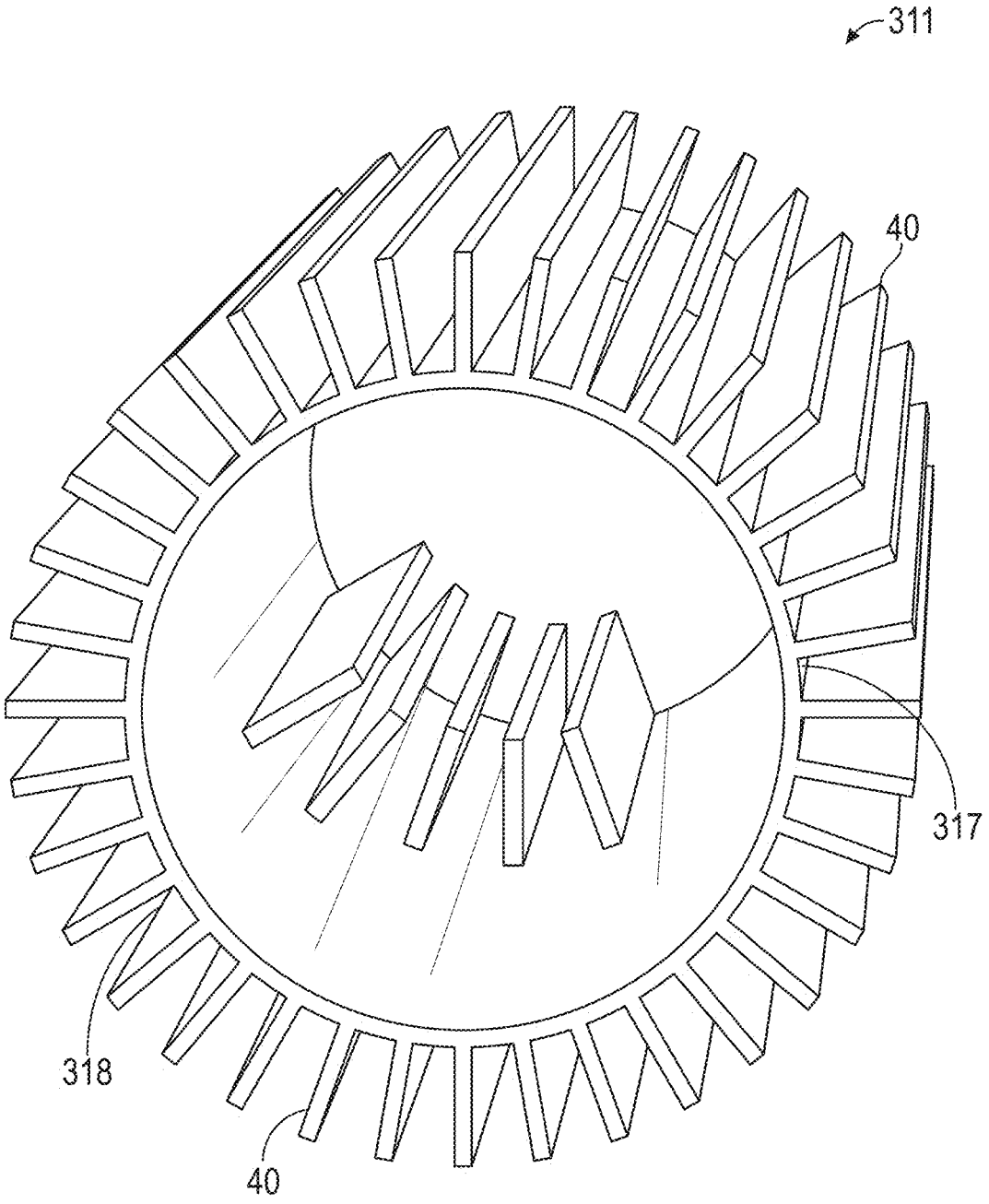
FIG. 5A illustrates a cross-sectional view of a flow pipe used in an evaporative cooling system according to one or more embodiments.
Figure 5B:
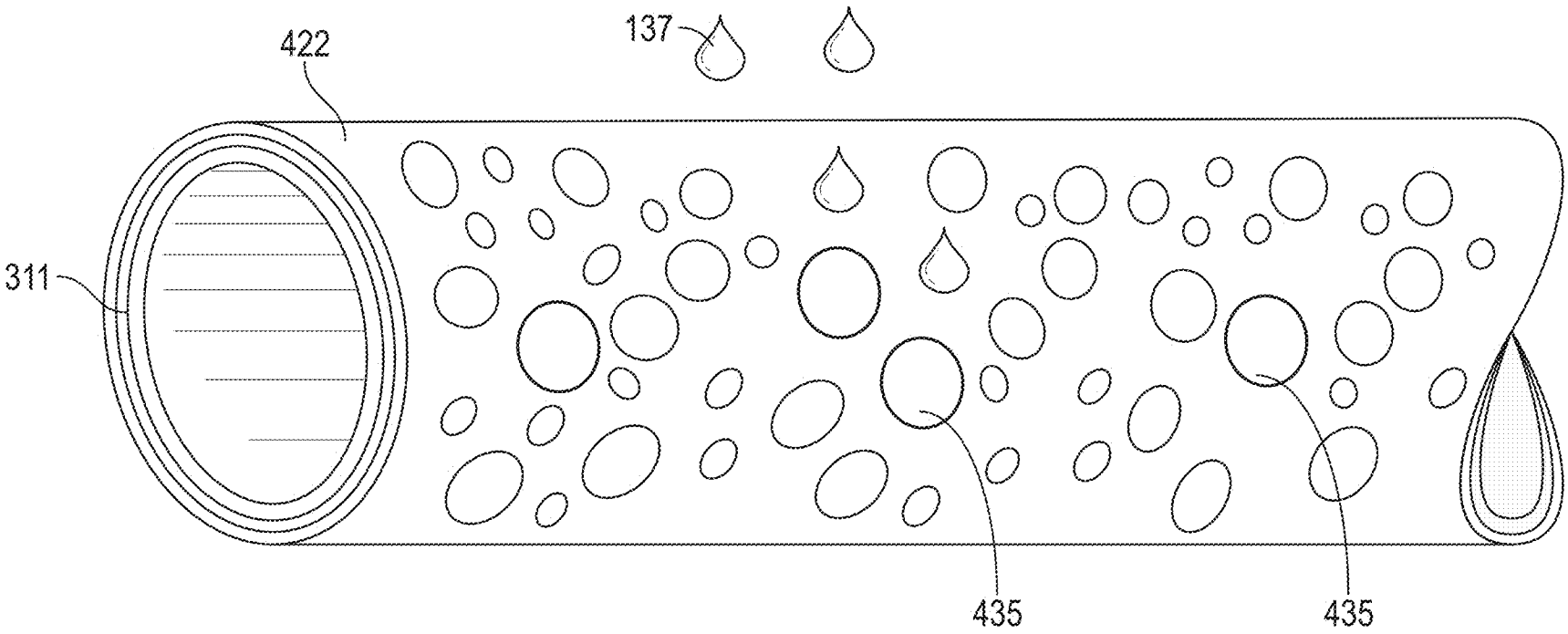
FIG. 5B illustrates a cross-sectional view of a flow pipe used in an evaporative cooling system according to one or more embodiments.
Figure 5B:
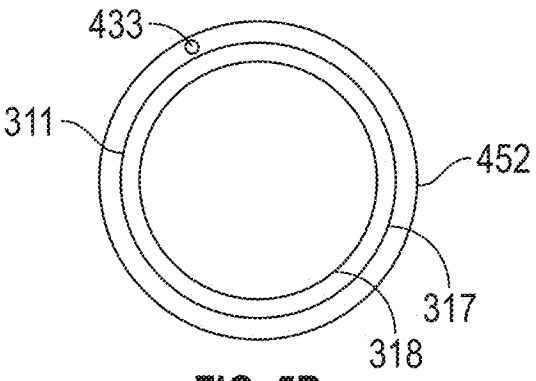
Figure 5C:
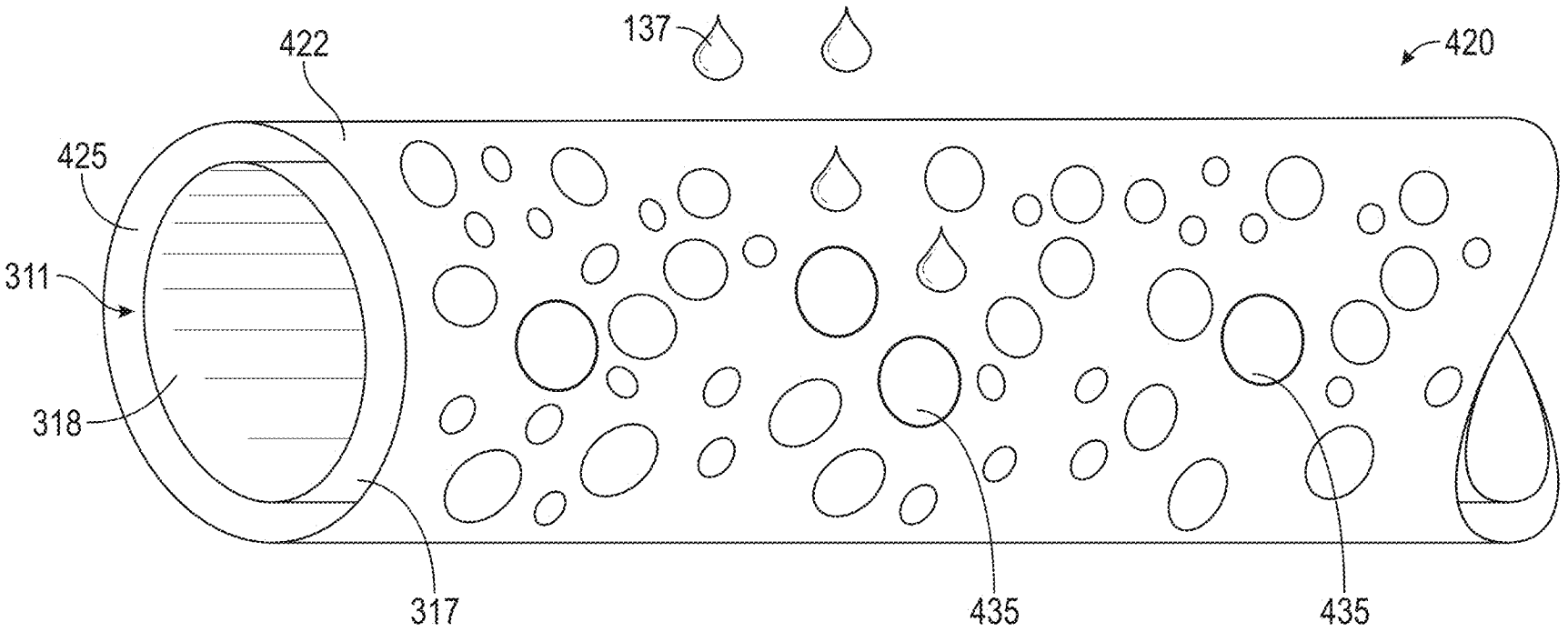
FIG. 5C illustrates a cross-sectional view of a flow pipe used in an evaporative cooling system according to one or more embodiments.
Figure 5C:
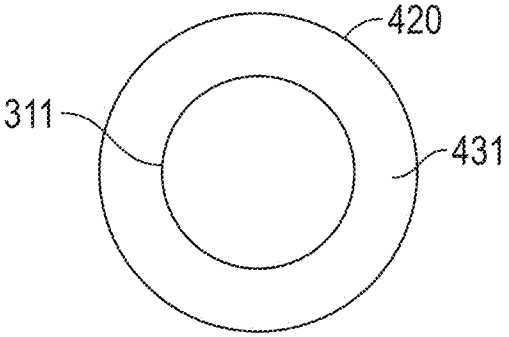

FIGS. 5A-C illustrate examples of flow pipe that may be used in an evaporative cooler. FIG. 5A illustrates a cross-sectional view of a flow pipe 311 (taken along a plane traversing the central axis of the pipe) useful in an evaporative cooler 310 in accordance with one or more embodiments. The flow pipe 311 may have a pipe wall with an outer surface 317 and an inner surface 318. The pipe wall of the flow pipe 311 in FIG. 5A is cylindrical and has a circular cross-sectional profile. In one or more embodiments, the flow pipe 311 may have a various cross-sectional profile shapes, including but not limited to, ovals, squares, or other polygons. A non-circular cross-sectional profile with a flatter or wider shape may maximize surface area contact between fluid flowing through the pipe and the inner surface of the pipe. For example, a temperature gradient formed through the pipe cross-section may increase from cooler temperatures at the pipe wall to hotter temperatures in the pipe center. By reducing the flow area through the flow pipe (e.g., by flattening the flow pipe cross-section shape or reducing the diameter of the flow pipe), the fluid to surface area contact in the pipe may be maximized, and therefore provide increased cooling to the fluid flowing therethrough. Thus, the cross-section shape of a flow pipe may be chosen to minimize the distance from a pipe center to the pipe wall.

While reducing the flow area through a flow pipe may maximize the fluid to surface area contact in the pipe (and provide increased cooling to the fluid flowing therethrough), such reduction in the flow area may increase pumping requirements to move the fluid through the flow pipe. In some embodiments, flow pipe 311 may be configured to include structures, such as fins or a bristled structure, to provide increased surface area of the pipe while minimizing internal flow area reduction. For example, external fins 406 may be attached to or integrally formed with the outer surface 317 of the flow pipe 311. For example, fins may be flattened protrusions extruding outwardly from the pipe wall of the flow pipe 311 to increase the external surface area for cooling. Optionally, internal fins 407 may be attached to the inner surface 318 of the flow pipe 311 and extend radially inward from the pipe wall. Such fins increase the surface area of contact with the evaporative medium or the mud to transfer heat outwardly. In some embodiments, the outer surface 317 of the flow pipe may contain indentations configured to pool the evaporative medium.

The fins may be made of any material suitable for the operation, such as steel or aluminum. The fins may be coupled or connected to the flow pipe by any means known in the industry, such as welding. Optionally, the fins may be manufactured with the flow pipe such that they are integral to the structure. Those having skill in the art will appreciate that several different types of materials may be used to make and attached the fins.

FIG. 5B illustrates a sectional perspective view and a cross section of another example of a flow pipe 311 used in an evaporative cooler according to one or more embodiments. The flow pipe 311 includes a pipe wall having an outer surface 317 and an inner surface 318, through which fluid may flow. In one or more embodiments, the flow pipe 311 may be enclosed or encased in a covering 452 wrapped around the outer surface 317 of the flow pipe 311. The covering 452 may be coupled or connected to the outer surface 317 of the flow pipe 311 by any means known in the industry, such as wrapping the covering 452 around the flow pipe 311 and holding the wrapping in place with a wire. In one or more embodiments, the covering 452 may be made of materials, including but not limited to, clay, fiber reinforced clay, mineral based coatings like terracotta or cement, fabric (for example, glass wool or woven glass wool), aramid fabric or aramid cloth, Cordura®, cotton, or nylon such as ballistic nylon. Cordura® products are a collection of synthetic fiber-based fabric usually made of nylon, but can be a blend of nylon with cotton or other natural fibers. The Cordura® registered trademark is the property of Invista, a subsidiary of Koch Industries. Materials like aluminum may also be used as a covering. In one or more embodiments, aluminum may be wrapped around a flow pipe to form a bristled surface. Those having skill in the art will appreciate that several different types of materials may be used to make the flow pipe and covering and to connect sections of the flow pipe together. Those having skill in the art will also appreciate that the group of materials listed may be selected and combined with other materials that may or may not be listed.

In one or more embodiments, the covering 452 may be a porous coating, which may be made of a porous material, or may have pores 435 or openings formed through the covering 452 having various shapes including but not limited to circles, ovals, squares, or polygons. An evaporative medium 137 may enter and fill the pores 435 and collect in the covering 452. Consequently, the evaporative medium 137 may be retained around the outer surface 317 of the flow pipe 311. In one or more embodiments, the covering 452 may cover one or more small-bore pipes 433 or tubes to distribute an evaporative medium 137. In one or more embodiments the one or more small-bore pipes 433 may be porous allowing distribution of the evaporative medium 137 near the outer surface 317 of the flow pipe 311.

FIG. 5C illustrates a cross section of another example of a flow pipe 311 used in the evaporative cooler according to one or more embodiments. In one or more embodiments, the flow pipe 311 may be enclosed in a second pipe 420 coupled or connected to the outer surface 317 of the flow pipe 311. The second pipe 420 comprises a second inner surface 425 and a second outer surface 422. The space between the outer surface 317 of the flow pipe 311 and the second inner surface 425 of the second pipe 420 forms a piping anulus 431. In one or more embodiments, the second pipe 420 may be configured to have pores 435. An evaporative medium 137 may enter and fill the pores 435 and collect in the piping anulus 431. Consequently, the evaporative medium 137 is retained in the space between the second inner surface 425 and the outer surface 317 of the flow pipe 311. In one or more embodiments, the second pipe 420 may have a various cross-sectional profile shapes including, but not limited to ovals, squares, or polygons. In one or more embodiments, the second outer surface 422 of the second pipe 420 may contain indentations configured to pool the evaporative medium. In one or more embodiments, an evaporative medium 137 may be distributed directly in the piping anulus 431. In example embodiments, the piping anulus 431 is configured to contain one or more small-bore pipes 433 to distribute an evaporative medium. In one or more embodiments, the one or more small-bore pipes 433 may be porous allowing distribution of the evaporative medium 137 near the flow pipe 311. In one or more embodiments, the piping anulus 431 may contain materials including but not limited to clay, fiber reinforced clay, mineral based coatings like terracotta, cement, fabric (for example, glass wool or woven glass wool), aramid fabric or aramid cloth, Cordura®, cotton, or nylon such as ballistic nylon. Materials like aluminum may also be used as a covering. In one or more embodiments, aluminum may be wrapped around a flow pipe to form a bristled surface.

Methods

In one or more embodiments, an evaporative cooler may be transported via truck to cool a fluid. Multiple evaporative coolers may be used. The evaporative coolers may be coupled together in series or in parallel depending on factors, such as, but not limited to, ambient temperature, humidity, volume, and temperature of the fluid to be cooled.

Features such as solar panels and a cover may be folded open or be in a functional position, respectively. Storage tank(s) may be filled with an evaporative medium, such as water, and fluidly connected to the evaporative cooler(s). An evaporative cooler may operate continuously. The evaporative medium may be replenished when running low.

In one or more embodiments, the evaporative cooler is part of an evaporative cooling system and may have an onboard sensor coupled to a computer processor that may utilize an algorithm or set of instructions to, for example, monitor and direct cooling performance. As an example, such systems may include, but are not limited to, meters to optimize the distribution of an evaporative medium and control valves to meter and divert the mud as required. In one or more embodiments an automated system may detect the flow rate of the mud, and the inlet and outlet temperature of the mud. The automated system may determine and control the flow rate and the amount of evaporative medium introduced to the flow pipe. In more or more embodiments an automated system may have a moisture sensor and a control valve and may distribute the evaporative medium to dry areas of flow pipe.

Figure 6:
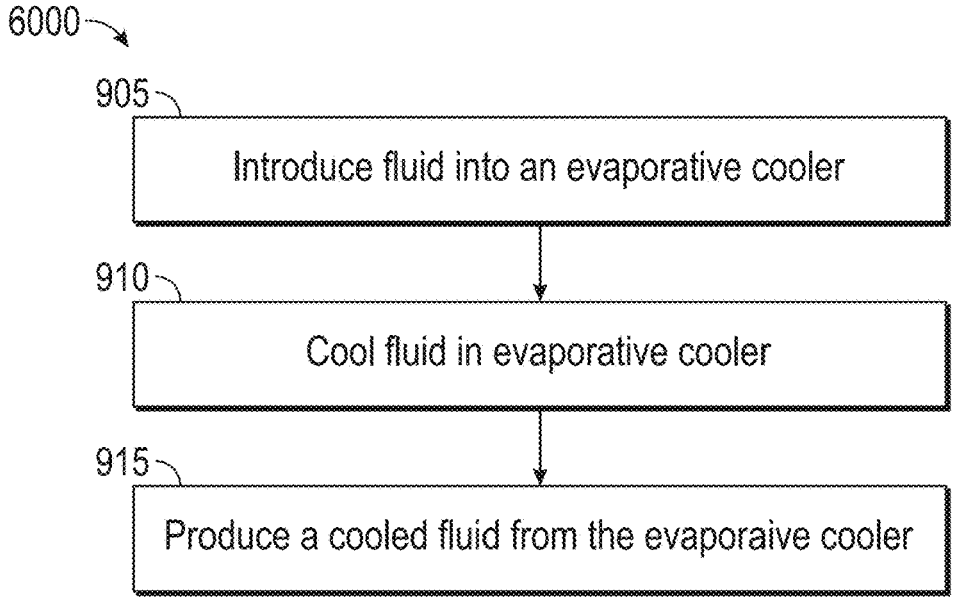
FIG. 6 is a flowchart that illustrates a method of using the evaporative cooler of in accordance with one or more embodiments.

FIG. 6 is a flowchart that illustrates a method of using an evaporative cooler in accordance with one or more embodiments. In method 6000 of using an evaporative cooler, a fluid is introduced into the evaporative cooler 905. The fluid is cooled in the evaporative cooler 910. The cooled fluid is produced from the evaporative cooler 915.

In one or more embodiments, the evaporative cooler is part of an evaporative cooling system and may be transported via truck to the wellsite. Flexible hoses may be used to fluidly couple the evaporative cooling system to the drilling rig or to mud pits near the drilling rig. Multiple evaporative cooling systems may be used at a drilling site.

Figure 7:
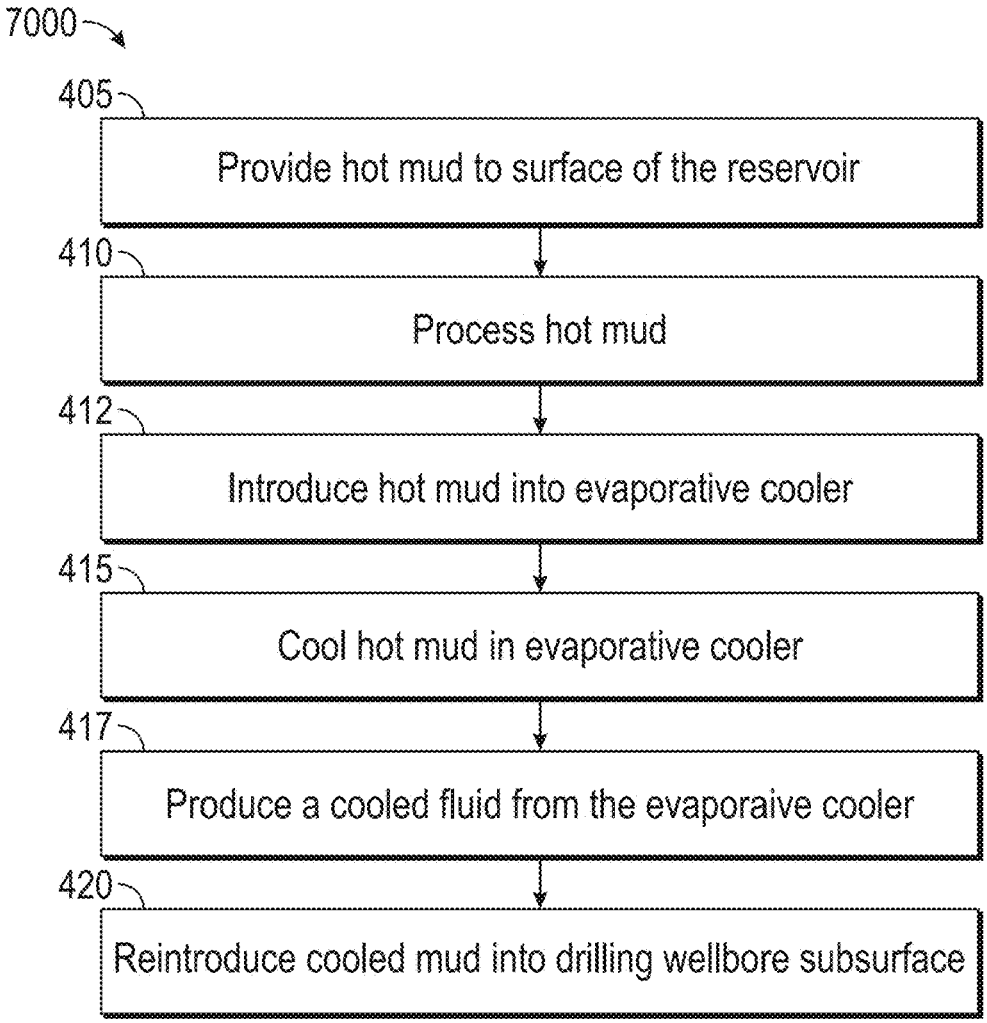
FIG. 7 is a flowchart that illustrates a method of using the evaporative cooler of in accordance with one or more embodiments.

FIG. 7 is a flowchart that illustrates a method of using an evaporative cooling system in accordance with one or more embodiments. In the method of use of the system, hot mud from a drilling system is passed to an evaporative cooler to be cooled.

In step 405 of method 7000 in one or more embodiments, a hot drilling fluid containing a mud near the distal end of a drill pipe is carried to the surface. The hot drilling fluid is carried up to the surface via a wellbore annulus through a mud return line.

In method 7000 of FIG. 7, step 410 shows drilling fluid containing the mud being processed on the surface. In one or more embodiments, the hot drilling mud is passed to mud degasser to remove gases from the drilling fluid. The hot drilling mud may then be passed to a shale shaker where micro-sized solids and debris are separated from the hot drilling mud. In one or more embodiments, the hot drilling mud is then passed into a mud storage.

As previously described, in one or more embodiments, the hot drilling mud is then introduced into an embodiment evaporative cooler in step 412 of method 7000 of FIG. 7. The hot drilling mud passes into a flow pipe of the evaporative cooler from an inlet and the mud is in contact with the inner surface of the flow pipe. Hot drilling mud directed from a drilling system to an evaporative cooler may have temperatures near downhole temperatures in the well from which the drilling mud is being returned. For example, the temperature of hot drilling mud introduced into an evaporative cooler from a drilling system may range from about 90 to 130 degrees Celsius, e.g., 100 to 120 degrees Celsius.

As hot drilling mud is introduced into and flowed through a flow pipe in an evaporative cooler, an evaporative medium may contact the outer surface of the flow pipe of the evaporative cooler to cool the hot drilling mud in step 415 of method 7000 of FIG. 7 according to one or more embodiments. An evaporative medium may be sprinkled, sprayed, or otherwise introduced to the outer surface of the flow pipe. Several types of compositions may be used as an evaporative medium, including but not limited to, some alcohols, wetting agents, or surfactants (e.g., soaps). In one or more embodiments, additives may be added to the evaporative medium. An additive may be used to increase the specific heat capacity or to reduce freezing point. For example, ethylene glycol may reduce the freezing point of the evaporative medium.

In one or more embodiments, liquid water may be use as an evaporative medium. Water is a useful evaporative medium because it is usually non-toxic, easily available in large volumes, and leaves minimal trace solids upon evaporation. In one or more embodiments, trace solids may be periodically removed from the outer surface of the flow pipe. Further, water phase changes from liquid to gas within a temperature range suited to evaporative cooling applications at drilling. In one or more embodiments, salt water may be used as the evaporative medium. In one or more embodiments, the water may be stored and dispensed from storage tanks are attached to a transportation frame of the evaporative cooler.

In one more embodiment, a cover with an opening may be attached to the transportation frame of the evaporative cooler. The opening at the top of the cover increases evaporation by encouraging convective airflow over the flow pipe in the evaporative cooler as a hot evaporative medium disperses into the environment by upward airflow. For example, the hot drilling mud inside the flow pipe heats the inner surface of the flow pipe and the heat is transferred to the outer surface of the flow pipe. The evaporative medium is in contact with the outer surface of the flow pipe and is in a liquid state. The evaporative medium absorbs heat from the flow pipe and phase changes to a gaseous state. The gaseous evaporative medium rises and contacts the inner surface of the cover. As the heat from the gaseous evaporative medium disperses into the environment, the evaporative medium cools and condenses to a liquid again. The liquid evaporative medium in contact with the inner surface of the cover may be reclaimed as it falls back down on the flow pipe outer surface to absorb more heat. In this process, the reclaimed evaporative medium is recycled, thus reducing the consumption of larger amounts of evaporative medium. In one or more embodiments, condensed or liquid evaporative medium may fall and be collected into a trough or other type of fluid collection channel in the evaporative cooler (e.g., a collection pan or gutter provided by the frame of the evaporative cooler). The collected evaporative medium may be reclaimed and passed into an evaporative medium storage tank. For example, collected evaporative medium may be reclaimed from a fluid collection channel in the transportation frame and pumped to storage tank(s) via additional pipes.

In method 7000 of FIG. 7, step 417 shows that cooled drilling mud is produced from the evaporative cooler according to one or more embodiments. The cooled drilling mud may pass from the evaporative cooler into a mud storage where the mud may be stored until use. In one or more embodiments, mud may be circulated multiple times through the evaporative cooler to reduce the temperature of the mud. In one or more embodiments, mud may be circulated through an evaporative cooler until the mud reaches a temperature near or below 60 degrees Celsius, e.g., below 40 degrees Celsius.

As previously described, in one or more embodiments, when required, mud pumps draw cooled drilling mud from a mud storage and into a mud injection line coupled to the derrick and the drill pipe. In method 7000 of FIG. 7, step 419 shows that the cooled drilling mud is then reintroduced into the drilling wellbore from the drill pipe and back downhole in the subsurface toward the drill bit, where the circulation begins again.

In one or more embodiments, the transportation frame allows the evaporative cooler to be portable. The evaporative cooler may be configured as a container and transported via a truck to another drilling site after use. Pad eyes may be used to lift and secure the transportation frame during transportation. Further, the transportation frame may allow multiple evaporative cooling systems to be stacked on top of other evaporative cooling systems during use at a drilling site.

According to some embodiments of the present disclosure, rather than flowing mud through an evaporative cooler to directly cool the mud in the evaporative cooler, an evaporative cooler may be used to indirectly cool mud using a dual circuit evaporative cooling system. A dual circuit evaporative cooling system may include two flow "circuits," including a closed loop intermediate fluid circuit and a mud circuit. The closed loop intermediate fluid circuit may include a flow path through which an intermediate fluid is recirculated through an evaporative cooler to cool the intermediate fluid. The mud circuit may include a flow path directing mud from a drilling system to a heat exchange configuration with the closed loop intermediate fluid circuit to cool the mud via heat exchange with cooled intermediate fluid. In such manner, a dual circuit evaporative cooling system may be used to cool mud via heat exchange with an intermediate fluid cooled in an evaporative cooler. By using a dual circuit evaporative cooling system, intermediate fluid may be continuously cooled via an evaporative cooler, and because the intermediate fluid may be in a closed loop, chances of contamination within the evaporative cooler may be reduced. Additionally, by using an intermediate fluid cooled by an evaporative cooler to cool drilling mud, evaporative coolers different than ones specialized for having mud flowed directly therethrough may be used. For example, in some embodiments, a dual circuit evaporative cooling system may use a commercially available evaporative cooler to cool an intermediate fluid, where the cooled intermediate fluid may be used to cool drilling mud via heat exchange.

FIG. 8 is a diagram of an example dual circuit evaporative cooling system 805 according to embodiments of the present disclosure. The dual circuit evaporative cooling system 805 includes a mud circuit 820, where mud is cooled, and an intermediate fluid circuit 840, where intermediate fluid is cooled. The intermediate fluid is used as a heat transfer medium and circulated in the intermediate fluid circuit 840. The intermediate fluid in the intermediate fluid circuit 840 passes through an evaporative cooler 802, where the intermediate fluid is cooled, and through an intermediate cooler 822, where the intermediate fluid gains heat through heat exchange with drilling mud. The drilling mud is passed through the mud circuit 820 that is separate from the intermediate fluid circuit 840. In the mud circuit 820, the mud passes through the same intermediate cooler 822 that intermediate fluid circulates through; however, the mud does not circulate through the evaporative cooler 802.

The intermediate fluid circuit 840 may be a closed loop, where intermediate fluid may flow between the evaporative cooler 802 and the intermediate cooler 822 via intermediate fluid flow pipe 848. In the intermediate fluid circuit 840, intermediate fluid may be cooled in the evaporative cooler 802, and cooled intermediate fluid is directed through a cooler outlet 846 and the intermediate fluid flow pipe 848 to the intermediate cooler 822. In the intermediate cooler 822, heat is exchanged between relatively warmer mud and the cooled intermediate fluid. Heated intermediate fluid is returned from the intermediate cooler 822 to the evaporative cooler 802 via the intermediate fluid flow pipe 848 and a cooler inlet 844. The hot intermediate fluid from the intermediate fluid flow pipe 848 is cooled in the evaporative cooler 802, and the loop may begin again. In the mud circuit 820, hot drilling mud contained in a mud flow pipe 828 passes from a mud source 824 (e.g., a mud pit or other part of a mud circulation system) to a mud inlet of the intermediate cooler 822. In the intermediate cooler 822, the heat from the hot drilling mud transfers to the cooled intermediate fluid, thereby decreasing the temperature of the mud and increasing the temperature of the intermediate fluid.

In one or more embodiments, mud exits the intermediate cooler 822 via a mud outlet and may be reused in drilling operations 826. The heated intermediate fluid returns to the evaporative cooler 802 thereby completing the circuit.

In one or more embodiments, the evaporative cooler 802 is configured to contact and evaporate 803 an evaporative medium.

In one or more embodiments, the intermediate cooler 822 is configured such that is it located inside a mud pit. In such embodiments, the cooled intermediate fluid in the intermediate fluid flow pipe 848 circulates through the heat exchanger located in a mud pit.

In one or more embodiments, the intermediate cooler 822 uses a heat exchanger. Those having skill in the art will appreciate that several different types of heat exchangers may be used. In one on or more embodiments, a heat exchanger allows fluids into close proximity. For example, fluids may flow through a pipe-in-pipe arrangement or between closely spaced channels. In one or more embodiments, the heat may be a compact plate heat exchanger.

Unless defined otherwise, all technical and scientific terms used have the same meaning as commonly understood by one of ordinary skill in the art to which these systems, apparatuses, methods, processes and compositions belong.

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

Ranges may be expressed as from about one particular value to about another particular value, inclusive. When such a range is expressed, it is to be understood that another embodiment is from the one particular value to the other particular value, along with all particular values and combinations thereof within the range.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. An evaporative cooler, where the evaporative cooler comprises:

a flow pipe having an inner surface configured to be in contact with drilling fluid;

an outer surface configured to be in contact with an evaporative medium;

the flow pipe in a serpentine configuration within a transportation frame; and a detachable transparent cover on top of and coupled to the transportation frame wherein the cover extends an area greater than a footprint of the transportation frame and the cover has a single opening on a side of the cover farthest away from the transportation frame.

2. The evaporative cooler of claim 1 wherein the serpentine configuration is in a horizontal dominant configuration.

3. The evaporative cooler of claim 1, wherein the transportation frame further comprises a storage tank provided at a top of the transportation frame, gravitationally above the flow pipe, where the storage tank is configured to contain and distribute the evaporative medium to the outer surface of the flow pipe.

4. The evaporative cooler of claim 1, wherein the transportation frame further comprises a solar panel, where the solar panel is configured to supply electricity to onboard sensors.

5. The evaporative cooler of claim 1, wherein external fins are provided along the outer surface of the flow pipe.

6. The evaporative cooler of claim 1, wherein internal fins are provided along the inner surface of the flow pipe.

7. The evaporative cooler of claim 1, wherein the evaporative medium is liquid water.

8. The evaporative cooler of claim 1, wherein the flow pipe has a covering extending around the outer surface of the flow pipe, wherein the covering is porous.

9. The evaporative cooler of claim 8, wherein the covering is made of a material selected from the group consisting of clay, fiber reinforced clay, terracotta, cement, fabric, glass wool, aramid cloth, cotton, nylon, ballistic nylon, aluminum, and combinations thereof.

10. The evaporative cooler of claim 1, wherein the detachable cover is configured to reclaim condensation of the evaporative medium and to allow the reclaimed evaporative medium to fall back down on to the outer surface of the flow pipe.

11. A system for cooling a drilling fluid, comprising:

a mud circulation system fluidly connecting the drilling fluid between a well and a surface; and an evaporative cooler fluidly coupled to the mud circulation system, wherein the evaporative cooler comprises a flow pipe in a serpentine configuration contained in a transportation frame, and wherein an inlet to the flow pipe and an outlet to the flow pipe are fluidly connected to the mud circulation system; and an intermediate cooler, wherein the intermediate cooler comprises a heat exchanger; and an intermediate fluid flow pipe fluidly connecting an outlet of the evaporative cooler and an inlet of the evaporative cooler to the heat exchanger.

12. The system of claim 11, wherein the mud circulation system comprises:

a mud degasser; and a shale shaker positioned downstream from the mud degasser and upstream from the evaporative cooler.

13. The system of claim 11, wherein the mud circulation system comprises a mud storage, and wherein the evaporative cooler is fluidly coupled to the mud storage.

14. The system of claim 13, wherein the mud circulation system further comprises a mud injection line fluidly connecting the mud storage to the well.

15. The system of claim 11, wherein the mud circulation system further comprises:

one or more mud pumps; and a recirculation line configured to circulate the drilling fluid to the evaporative cooler.

16. A method, comprising:

pumping a hot drilling fluid from a wellbore;

directing the hot drilling fluid to an evaporative cooling system, wherein the evaporative cooling system comprises an evaporative cooler;

using the evaporative cooling system to cool the hot drilling fluid;

directing cooled drilling fluid from the evaporative cooling system back to the wellbore;

an intermediate cooler, wherein the intermediate cooler comprises a heat exchanger; and an intermediate fluid flow pipe fluidly connecting an outlet of the evaporative cooler and an inlet of the evaporative cooler to the heat exchanger.

17. The method of claim 16, wherein the evaporative cooler comprises a flow pipe arranged in a serpentine configuration within a frame, wherein the hot drilling fluid is directed into an inlet of the flow pipe, and wherein the cooled drilling fluid is directed out of an outlet of the flow pipe.

18. The method of claim 17, further comprising:

pumping the hot drilling fluid from the wellbore to a mud storage;

pumping the hot drilling fluid from the mud storage to the evaporative cooler to cool the hot drilling fluid;

returning the cooled drilling fluid from the evaporative cooler to the mud storage; and directing the cooled drilling fluid from the mud storage to the wellbore.

19. The method of claim 16, further comprising:

cooling an intermediate fluid in the evaporative cooler;

flowing the cooled intermediate fluid from the outlet of the evaporative cooler, through the intermediate fluid flow pipe, to the heat exchanger;

flowing the hot drilling fluid through the heat exchanger, wherein heat exchange occurs between the hot drilling fluid and the cooled intermediate fluid to cool the drilling fluid and heat the intermediate fluid; and directing the heated intermediate fluid from the heat exchanger to the inlet of the evaporative cooler to cool the heated intermediate fluid.

* * * * *